US005842802A

United States Patent [19]

Lang et al.

[11] Patent Number: 5,842,802

[45] Date of Patent: Dec. 1, 1998

[54] DISPENSER

[75] Inventors: Frank J. Lang, Henderson, Nev.; Robert W. Chadfield, Bradenton, Fla.

[73] Assignee: Federal Package Network, Inc., Chaska, Minn.

[21] Appl. No.: 945,430

[22] Filed: Sep. 14, 1992

Related U.S. Application Data

[63] Continuation-in-part of Ser. No. 705,560, May 24, 1991, abandoned, which is a continuation-in-part of Ser. No. 613,285, Nov. 15, 1990, abandoned.

[51] Int. Cl.[6] ..... A45D 40/06

[52] U.S. Cl. ..... 401/68; 401/75; 401/79; 401/192; 401/175

[58] Field of Search ..... 401/68, 75, 76, 401/79, 175, 70, 86, 194, 98, 192; 40/306, 660, 661, 310

[56] References Cited

U.S. PATENT DOCUMENTS

| | | | |
|---|---|---|---|
| 955,617 | 4/1910 | Tucker | 401/79 |
| 1,781,852 | 11/1930 | Lyhne | 401/78 |
| 1,783,754 | 12/1930 | Stepelton | 401/175 |
| 2,368,997 | 2/1945 | Mitchell | 401/86 |
| 2,609,092 | 9/1952 | Braselton | 401/75 |
| 2,704,153 | 3/1955 | Florman | 401/75 |
| 2,844,893 | 7/1958 | Keller | 40/306 |
| 2,872,034 | 2/1959 | Harris | 401/86 X |
| 3,083,823 | 4/1963 | Metreaud | 401/86 X |
| 3,429,643 | 2/1969 | Seaver | 401/75 |
| 3,653,776 | 4/1972 | Geisel | 401/86 |
| 3,964,832 | 6/1976 | Cohen et al. | 401/75 |
| 4,044,889 | 8/1977 | Orentreich et al. | 401/98 X |
| 4,422,545 | 12/1983 | Kadoory | 401/98 X |
| 4,579,134 | 4/1986 | Moore | 401/98 X |

FOREIGN PATENT DOCUMENTS

| | | | |
|---|---|---|---|
| 470276 | 12/1950 | Canada | 401/79 |
| 387213 | 9/1990 | European Pat. Off. | 401/68 |
| 1019835 | 1/1953 | France | 401/194 |
| 1144093 | 10/1957 | France | 401/192 |
| 2556941 | 6/1985 | France | 401/75 |
| 3118893 | 11/1982 | Germany | 401/68 |
| 246657 | 2/1926 | United Kingdom | 401/68 |
| 2203099 | 10/1988 | United Kingdom | 401/194 |
| 8600203 | 1/1986 | WIPO | 401/98 |

*Primary Examiner*—Steven A. Bratlie
*Attorney, Agent, or Firm*—Francis J. Bouda; Breiner & Breiner

[57] ABSTRACT

The coating implement of the present invention dispenses solid material from an open-ended body for rubbing contact with a surface by ejecting the material from the open end of the body. The body has a manually operable collar secured near the upper open end thereof. The body has a screw and a screw-mounted elevator therein. The screw includes a knurled knob. The body is located in the tube with the knurled knob in frictional engagement with the inner lower end of the tube. Indicia may be placed on the outer surface of the body where it is protected by the tube, and the tube is transparent so that the indicia may be viewed therethrough. Rotation of the collar causes the body to rotate within the tube and eject the material from the body.

1 Claim, 2 Drawing Sheets

DISPENSER

This Application is a CONTINUATION-IN-PART of prior U.S. patent application Ser. No. 07/613,285 filed Nov. 15, 1990 (now abandoned) and a CONTINUATION-IN-PART of prior U.S. patent application Ser. No. 07/705,560 filed May 24, 1991 (now abandoned).

BACKGROUND OF THE INVENTION

The present invention relates to coating implements for dispensing a supply of material, particularly where the material is semi-solid, such as a gel or a cream, or a salve, and wherein the material is applied by a rubbing contact with the surface on which it is to be applied.

It more particularly relates to tubes such as those used to apply lipstick or lip salve, and wherein the material to be applied can be ejected from the container by a propel action and returned to the container with a repel action, particularly by twisting action of the container.

Such implements are generally classified in the U.S. Patent Office in Class 401/49 et. seq., and more particularly in Subclasses 68 and 72.

Illustrative of the well-known devices are those shown in the U.S. Pat. No. issued to Lang 3,917,417; Landon U.S. Pat. No. 3,335,854; Seaver U.S. Pat. No. 3,429,643; Gentile U.S. Pat. No. 4,363,560; Harris U.S. Pat. No. 2,872,034 and Lyhne U.S. Pat. No. 1,781,852.

Some of the earliest of these types of dispensers go back to the early part of the century, and Recker U.S. Pat. No. 1,499,784 is basically illustrative. As shown in Recker, a tube contains the material to be dispensed, and a screw mechanism is placed within the tube. An elevator, slidably mounted within the tube and actuated by the screw, rides up and down within the tube when the screw (or a knob on the end thereof) is turned.

The material to be dispensed is placed within the tube, around the screw and on top of the elevator, and thereafter a closure cap is placed over the open end.

By turning the knob (and screw), the elevator is made to rise, forcing the material from the top of the tube after the cap is removed. When it is desired to retract the material within the tube, the screw is rotated in the opposite direction, withdrawing the elevator and pulling the material back into the tube.

The prior art devices in most instances are difficult to operate because the screw activating knob is generally placed at the remote end of the tube from which the material is dispensed.

OBJECTS OF THE INVENTION

Therefore it is an object of the invention to provide a dispensing tube for cosmetics, lip salves and the like which can be activated by operating the propel-repel mechanism adjacent the end of the tube from which the material discharged.

Another object of the present invention is to provide a holder mechanism for well-known present-day dispensers which can be economically and inexpensively applied to existing devices so as to change the location of the control of the tube-twisting mechanism.

Another object of the present invention is to provide a transparent shield for a lip-salve dispenser which protects the indicia on the dispenser.

Another object of the present invention is to improve the design and operation of lipstick and lip salve dispensers, as well as the tube twisting and control mechanism therefor.

SUMMARY OF THE INVENTION

In the present invention, a transparent tube is provided which can slip over the body of a lip salve dispensing device. The bottom end of the tube.is closed and is proportioned in such a manner so that the screw-twisting knob of the dispenser fits tightly and securely at the bottom of the tube.

A ring or collar is formed at the upper end of the body of a well-known lip salve dispenser, and is a part of the dispensing body and positioned in such a manner and location that it resides closely above the upper open end of the newly-provided tube when the dispenser has been inserted and secured in the tube.

Whereas in the prior art, a knob at the bottom of the screw, at the bottom end of the dispenser, was manually turned in order to propel or repel the material, in the present invention the turning of the collar at the upper end of the body causes the body itself to turn relative to the screw and knob. Thus the relative movement between the turning collar and body, on one hand, and the stationary screw and tube on the other hand, causes the elevator to rise on the screw and the material to be ejected from the upper end of the container.

Thus it is the provision of a simple closed-bottom transparent tube and a simple ring or collar on the body which inexpensively converts a standard lip-dispensing device into a mechanism which can be controlled at the upper or dispensing end of the dispenser and which protects any indicia on the outside of the body.

It is an object of the present invention to provide a multi-body dispenser, which can be attractively and inexpensively decorated and in which the decoration is protected from abrasion.

Still a further object of the present invention is to provide a dispenser wherein the body and the tube can be made of separate materials (i.e., transparent or opaque, or of separate colors) so as to attractively present an improved dispenser which will not be disfigured in use.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized, and that the invention is not limited to the precise arrangements and organizations of the instrumentalities as herein shown and described.

In the drawings, wherein like reference characters indicate like parts:

Figure 1:
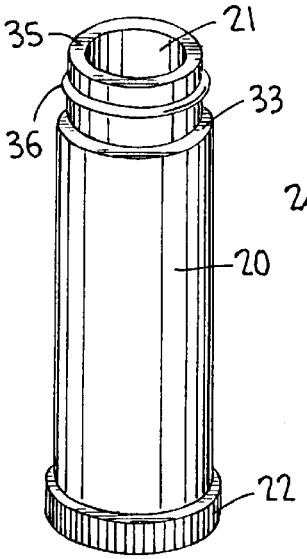
FIG. 1 (PRIOR ART)
FIG. 1 is a perspective view of a lip salve dispenser of the prior art (with a cap removed).
Figure 2:
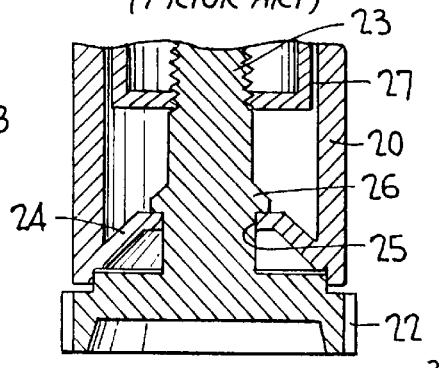
FIG. 2 (PRIOR ART)
FIG. 2 is a fragmentary vertical cross-sectional view of the bottom of a lip salve dispenser of the prior art showing the screw-and-knob-twisting mechanism.

Referring now to FIG. 1 and FIG. 2, the prior art dispensers generally included a body 20 from which the material to be dispensed is ejected through the open end 21.

At the other end of the body 20, a knob 22 is secured to a screw 23, and the assembled screw-and-knob are held in place within the body 20 by a bottom arrangement 24 which has a hole 25 through which the screw 23 projects and against which the screw 23 is retained by a collar 26.

An elevator 27 rides up and down on the screw 23 within the body 20 when the knob 22 is rotated, thus propelling and repelling both the elevator 27 and any material within the body.

Thus it can be clearly seen that the material is ejected from the open end 21 of the body 20 by rotating the knob 22 at the opposite end of the body.

In the present invention, there is provided an inexpensive arrangement to enable the control to be accomplished at the upper end of the dispenser and to protect any indicia on the outer surface of the body. This includes a collar 28 and a tube 29, shown more clearly in FIGS. 5 and 6.

The collar 28 has a knurled outer surface 30 to provide easy anti-friction grasping thereof, and in one embodiment is a separate ring tightly fitted as by press-fitting, adhesively securing, welding or otherwise fastening the inner-surface 31 thereof to the outer body surface 32 at the upper end of the body 20. This can be accomplished closely adjacent the shoulder 33 against which a cap 34 can be tightened when the cap 34 is fastened onto the upper body end 35 by snapping it over the ridge 36 which is moulded in the upper end 35 of the body 20.

Figure 6:
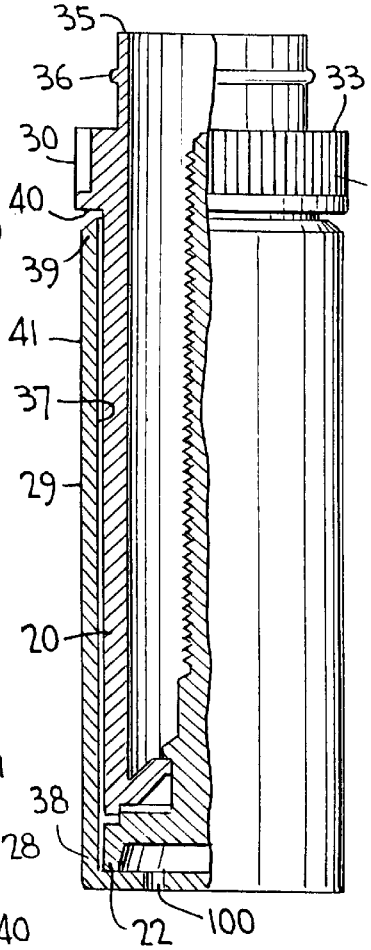
FIG. 6 is a vertical cross-sectional view similar to FIG. 3 illustrating an assembled dispenser of the present invention wherever the collar is an integral part of the body.

In the preferred embodiment shown in FIG. 6, the collar 28 is formed integrally with the body 20.

In either case, the ring 28 is integral with the body 20, and the outer knurled edge 30 projects diametrically away from the outer surface 32 of the body 20.

As has been previously mentioned, the normal rotating knob 22 of prior art devices is at the bottom of the body 20, and it also has an outer diameter which extends beyond the outer diameter of the body 20, but not as far as the outer diameter of the ring 28.

Therefore, by providing the tube 29, the inner diameter 37 of which is so dimensioned, particularly at the bottom 38 thereof, so that when the dispenser body 20 is slipped within the tube 29 and the knob 22 pushed down to the bottom 38, the knob 22 is in press-fit (i.e., non-rotating ) engagement with the innerwall of the tube 29, and thus the knob 22 is securely held against any rotation with respect to the tube 29.

A small vent hole 100 is in the bottom of the tube to enable the assembly and filling of the dispenser to be done easily.

The upper end 39 of the tube 29 terminates just shortly beneath the underside 40 of the ring 28 when the knob 22 is "bottomed" within the tube 29.

As can be clearly seen in FIG. 6, the outer diameter of the knurled portion 30 of the ring 28 may extend beyond the outer diameter 41 of the tube 29. In any event, if the outer diameter of the ring 28 is the same as the outer diameter 41 of the tube 29, the knurled characteristic of the ring 28 makes it easy to turn the body 20 with respect to the tube 29.

Figure 5:
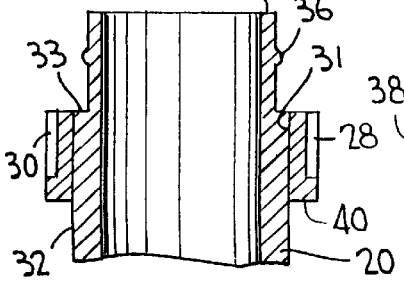
FIG. 5 is a fragmentary vertical cross-sectional view showing how a control collar may be applied to the upper end of a dispenser body.
Figure 7:
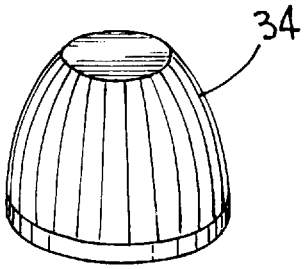
FIG. 7 is a perspective view of a typical cap which can be used as a closure for the upper end of the dispenser.

Although the ring 28 has been described in one embodiment as a separate piece press-fitted onto the body 20 (as illustrated in FIG. 5) so that the ring and the body become an integral piece, it is preferred that the ring 28 be molded as a part of the body 20 as is shown in FIG. 6. Furthermore, the components of the body may be either plastic or metal, as desired.

Figure 8:
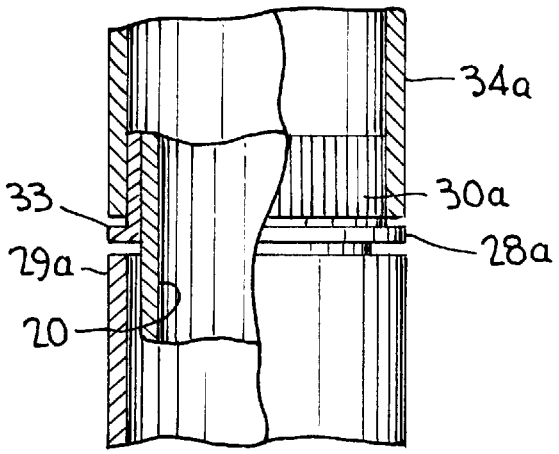
FIG. 8 is a fragmentary, partial cross-sectional view of the improved dispenser of the present invention, illustrating particularly the use of a multi-color arrangement.
Figure 9:
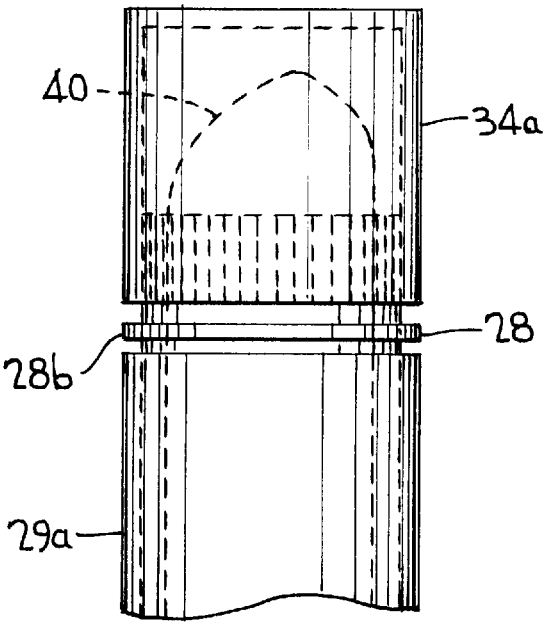
FIG. 9 is an elevational view, partially in section, similar to FIG. 8, more clearly illustrating the effective use of a transparent tube around the body of the dispenser of the present invention.

In FIGS. 8 and 9, there is disclosed the preferred embodiment of the dispenser of the present invention designed more fully to take advantage of marketing characteristics for this type of dispenser.

In FIG. 8, the portion 28-*a* of the ring 28 is substantially the same diameter as the outer surface of the tube 29-*a*, as well as the outer surface of the cap 34-*a*. This provides a more attractive marketing device where the outer surfaces of the assembled dispenser are substantially the same. It also improves the effectiveness of manufacturing and packaging the dispenser of the present invention.

A portion 30-*a* of the ring 28 is of smaller diameter than the portion 28-*a* and is knurled. This provides not only a non-slip, one-hand turning means (when the cap 34-*a* is removed) but the outer tips of the knurling are carefully designed and dimensioned to provide an easy slip-on, frictionally-mating engagement with the inner surface of the cap 34-*a*.

This arrangement is designed particularly so that the ring 28 may be rotated by turning the cap 34-*a* if it is in place upon the knurled portion 30-*a*. It also provides for manual, one-hand rotation of the ring 28-*a* by turning on the knurled portion 30-*a*when the cap 34-*a* is removed.

This arrangement enables the user to rotate the dispensing mechanism and to eject the contents partially out of the dispenser, within the cap 34-*a*, if desired.

The desirability of such rotation, dispensing and ejecting as heretofore just described provides a marketing advantage so that the purchaser of the tube may observe the color of the contents of the tube without removing the cap 34-*a*, when the cap 34-*a* is a clear transparent material. This arrangement is shown in FIG. 9 where the transparent cap 34-*a*, in place upon the knurled portion 30-*a* of the ring 28, permits the observer to see the tube-contents 40 within the clear cap 34-*a*.

This characteristic of visual observation is advantageous, not only for the retail purposes at the cosmetic counter, but also permits the purchaser and ultimate user to retain the contents in an exposed or partially dispensed position, with a cap in place, so that if a multiplicity of such dispensers are arranged side-by-side, the precise contents and color of the contents can be discerned without removing the cap.

More importantly, the one-hand operation of the device of the present invention permits the dispenser to be used by disabled persons or one-handed persons. Although it might be argued that the one-hand manipulation of such dispensers is possible with devices of the prior art where the dispensing-rotation mechanism is located at the bottom of the dispenser, it will be obvious that such arrangement would dispense the product downwardly into the palm of the hand of the person manipulating the device. Even if that disadvantage is overcome, then the tube has to be rotated in the hand so that the dispensed product is extending upwardly and outwardly in its customary fashion.

Still a further advantage of the present invention is that the outer tube 29-*a* can also be made of a clear, transparent plastic material, so that all of the advertising, promotional and identification material can be printed on the outer surface of the inner body member 20. This provides for a greater variety of printing processes to be used on the outer surface of the inner member 20, all of which can be protected during use by the clear outer tube 29-*a*. Without such a clear transparent outer tube, the indicia on the body is often scratched or rubbed off when coming into contact with keys, coins, or similar objects in the pockets or purse of the user.

It is particularly relevant that the body assembly of the present invention is functional and can be operated without the clear transparent tube thereon, and this distinguishes over the prior art which shows the use of transparent members.

Figure 3:
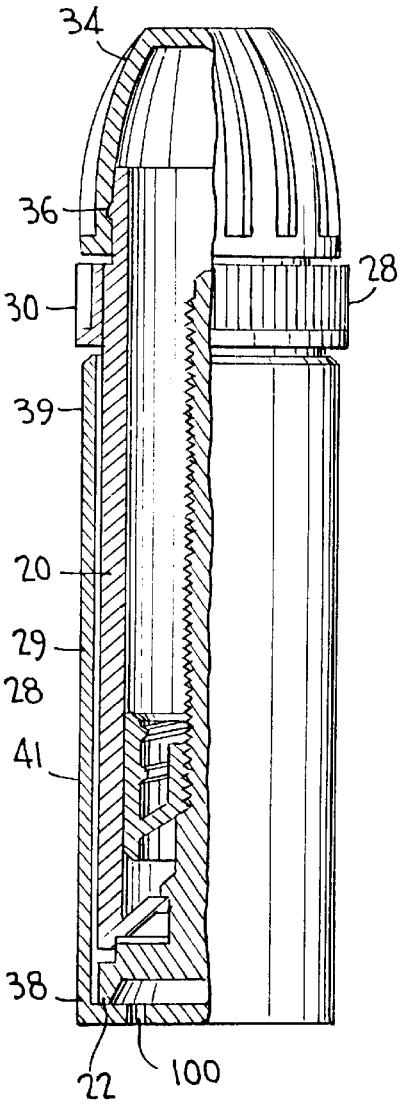
FIG. 3 is a fragmentary vertical cross-sectional view of one form of_the dispenser of the present invention.
Figure 4:
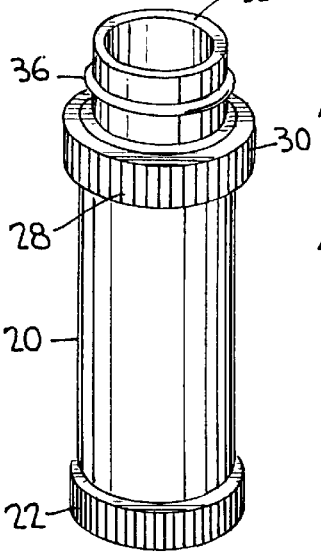
FIG. 4 is a perspective view similar to FIG. 1, without the outer tube, illustrating the control collar or ring at the top of the dispenser body.

One advantage of the embodiment shown in FIGS. 3 and 8 is that the portion 28-*b* of the ring 28 can be made of a color different from that of the body portion 29-*a* or the cap 34-*a* (if those parts are colored or opaque rather than transparent), thus providing another attractive marketing and identification characteristic for the contents and for the finished package.

Thus there has been described a simple and economical means for providing a propel-repel container for lip salve, lipstick or other cosmetics, which can be operated at the dispensing end of the container, and which includes a protective shield for indicia. It is a new and novel device which has not heretofore been described in the prior art or seen in public use.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

We claim:

1. In a dispensing implement for applying semi-solid material by rubbing contact including a tubular plastic body having an outer diameter and having one open end and one substantially closed end, a plastic screw mounted within and rotatable with respect to said body, said screw extending through said substantially closed end of said body, a knob on said screw external of the substantially closed end of said body, a plastic elevator mounted on said screw within said body and axially movable within said body, a cap-holder and a ring formed in said body near the open end thereof, said body having a smooth bore for quick-filling with a semi-solid material, a plastic cap arranged for removable attachment to said cap holder on said body, a plastic tube having an inner diameter and having one open end and one closed end, the inner diameter of said tube being larger than the outer diameter of said body and the closed end arranged to engage the knob of said screw and prevent relative rotary motion between the screw and the tube, a portion of said screw including means within said body adjacent the substantially closed end thereof to permit rotatable but not axial movement of said screw with respect to said body, said ring being a knurled collar on said body near the open end of said body and having an outer diameter substantially the same as the outer diameter of said tube, the open end of said tube abutting but rotatable with respect to said ring, said dispensing implement being an integral structure composed of the aforementioned elements and being operable to dispense semi-solid material therefrom even when said tube is removed from engagement with said knob or when said tube is cracked or broken or otherwise functionally inoperable.

* * * * *